US006176002B1

(12) United States Patent
Korb

(10) Patent No.: US 6,176,002 B1
(45) **Date of Patent: *Jan. 23, 2001**

(54) METHOD OF ATTACHING MATTRESS COVER HANDLE

(75) Inventor: Lothar Korb, Ajax (CA)

(73) Assignee: Leggett & Platt, Incorporated, Carthage, MO (US)

( * ) Notice: Under 35 U.S.C. 154(b), the term of this patent shall be extended for 0 days.

This patent is subject to a terminal disclaimer.

(21) Appl. No.: 09/418,202

(22) Filed: Oct. 13, 1999

Related U.S. Application Data

(62) Division of application No. 09/116,216, filed on Jul. 26, 1998, now Pat. No. 5,966,796, which is a division of application No. 08/820,044, filed on Mar. 19, 1997, now Pat. No. 5,884,352, which is a continuation-in-part of application No. 08/503,918, filed on Jul. 19, 1995, now Pat. No. 5,652,984.

(51) Int. Cl.[7] ..... B23P 11/02

(52) U.S. Cl. ..... 29/453; 29/91.1; 5/703

(58) Field of Search ..... 29/453, 91.1, 270, 29/278, 280, 242, 255; 5/703

(56) References Cited

U.S. PATENT DOCUMENTS 4,652,984 * 3/1987 Korb ..... 5/703

* cited by examiner

*Primary Examiner*—I Cuda Rosenbaum
*Assistant Examiner*—John C. Hong
(74) *Attorney, Agent, or Firm*—Wood, Herron & Evans, LLP

(57) ABSTRACT

The method of installing a handle in a mattress border comprising the step of bending a back strap and a material into a U shape so that inside surface is convex outward and so that first apertures are aligned, inserting a pulling tool through the aligned apertures, coupling a second coupling means to a first coupling means, and using the tool to pull the handle so that one of anchors passes through the first aligned apertures.

4 Claims, 16 Drawing Sheets

METHOD OF ATTACHING MATTRESS COVER HANDLE

This application is a divisional of application Ser. No. 09/116,216, filed Jul. 26, 1998 and now Pat. No. 5,966,796, which is a Divisional of application Ser. No. 08/820,044 filed Mar. 19, 1997, now U.S. Pat. No. 5,884,352, which is a Continuation-in-Part of application Ser. No. 08/503,918 filed Jul. 19, 1995, now U.S. Pat. No. 5,652,984.

This invention relates to a mattress handle assembly and to components associated therewith, individually and collectively designed to allow efficient attachment of the handle to the mattress and allowing such efficient attachment to be achieved by machine. The invention also relates to methods and means for attaching the handle to the mattress.

A mattress typically comprises a resilient core and a cover including top and bottom layers joined about their periphery by a border. The handle is attached to the mattress border before the attachment of the top and bottom layers to the mattress border. Hence the description to follow deals with the attachment of the handle to the border.

Typically, the handle has a flexible extent, having at each end, anchors, including a clip extending toward the other end while diverging from the flexible extent. The mattress border is provided with a pair of spaced apertures to receive the handle anchors. The spaced apertures are preferably defined by grommets. The grommets, in addition to attachment to the mattress border, preferably attach a back strap to the inside of the mattress border.

The grommet openings thus coincide with openings in the back strap.

By 'grommets' herein I include the standard metal grommet well known to those skilled in the art but also equivalents thereof. Such an equivalent can include a plastic member with a central opening, a flange which engages the outside of the border and a short tube which extends through the border opening to be formed around the edge and fastened to the back strap to be described. At the time of preparing this application the conventional metal grommet is preferred since it is not certain that the plastic can be fastened to the back strap with sufficient strength.

When the handle has been installed on the border the handle anchors are located on the inside of the border and the adjacent portions of the handles extend through the grommet openings. Clips on the anchor contact the adjacent grommet and prevent the inside to outside movement of the anchor through the adjacent grommet opening.

Under lifting pulls on the handle the clips bear on the grommet to transfer the lifting force from the handle to the mattress border.

A good example of the handle described above is shown in U.S. Pat. No. 2,703,415; dated Mar. 18, 1955, to Bechik.

Presently a handle of the Bechik type is manually attached to the grommets (and hence, to the mattress border and back strap) by inserting each anchor through the grommet, from outside to inside, with the clip resiliently deflected inward in passage to pass through the grommet. The clip then extends outwardly to contact the grommet and hold the handle in place.

It is an object of this invention to provide a handle having the clip attachment means as used with the prior handles, but which allows efficient attachment to the border, and is designed to facilitate attachment by machine methods.

Preferably, the grommets attach a back strap to the inside of the mattress border. The back strap has two spaced openings and at each opening is attached by the grommet to the inside of the mattress border. Thus when the handle, after installation, in used to pull or lift the mattress, the back strap assists in transferring the pulling force from the handle to the mattress border.

It is an object of this invention to provide such a back strap which is particularly shaped to allow gripping by clamping members adjacent each grommet opening, to allow bending of the mattress border and back strap to position the openings, for insertion of an anchor therethrough.

It is an object of this invention to provide a handle whose anchors will, at each end, extend through apertures in the mattress border, wherein the handle is designed so that its leading end may be drawn through the two apertures, (when positioned) so that the handle is thereby installed.

It is an object of this invention to provide that at least one, and preferably each, end of the handle is provided with a coupling member for coupling to a pulling tool so that the leading end of the handle when coupled thereto may be pulled through the grommet apertures when aligned.

It is an object of this invention to provide first coupling means on the anchor which is located at at least one free end of the handle, such first coupling means allowing detachable attachment of second coupling means on a pulling tool, so that the pulling tool may be extended through a grommet opening to pull the first coupling means and anchor through a grommet opening to install the handle.

In one variant the pulling tool is a straight rod. Clamping means grasp each back strap, adjacent the grommet and bends the border and back strap into a U shape and so that the grommet openings are aligned. At this time the back strap is on the convex side of the U. A straight puller rod, acting as the puller tool, may then be extended through the aligned openings and coupled to the first coupling means of a free end of a handle anchor. The rod then pulls the leading end through both aligned openings. The handle is now properly installed and, under lifting tension, will couple to the border since the clips will retain the handle in place.

In another variant, the clamping means grasps the back strap as before but the U shape is more of a V and the grommet axes are not parallel but on a common arc, for example, at 45°. A curved pulling rod is caused to move through the grommet holes, in the anti-pulling direction, to couple with the anchor at the leading end of the handle to draw it in an accurate path through both grommet holes, after which the handle is properly installed.

In a third variant the handle is shaped in a curve concave toward the outer surface of the border. In this variant each anchor is provided with first coupling means. The border and attached back strap, with a separate puller tool projecting through each grommet opening, are then bent into a V shape which is concave toward the handle. This bending and the positioning of the members are controlled to cause each pulling tool's second coupling means to couple with the handle's first coupling means at the adjacent end. The pulling tools may, then, each, pull the anchors through the grommet holes so that the handle is installed.

It is an object of the invention to provide anchors complete with coupling means, for attachment to the handle, which anchors may be formed from a flat blank having the spring clip at the end to be nearest the remote anchor, a middle portion for crimping about the handle, and at the end remote from the remote anchor, coupling means in a section preferably U shaped as viewed in section longitudinally of the handle.

The anchor with the U-shaped section has a middle portion and two outer portions, and the middle portion is provided with coupling means, preferably a tab diverging in the direction toward the other anchor, for coupling to a pulling member for drawing the anchor at leading end of the handle through the grommet openings.

Overall, it will be noted that the handle with leading anchor coupled to the pulling tool must have a profile to pass through the grommet openings.

In drawings which illustrate a preferred embodiment of the invention:

FIG. 1 shows part of the outside of a mattress with a handle, in accord with the invention, attached to the mattress border of the mattress, FIG. 2 is a section through the mattress border showing a handle, in accord with the invention, installed therein, FIG. 3 is an exploded view of a portion of the mattress border with grommets for attachment of a back strap thereto, FIG. 4 is a schematic view showing clamping members for clamping engagement with a back strap which is shaped in accord with the invention, FIG. 5 shows the blanks for forming inventive anchor members, FIG. 6 shows the blanks of FIG. 5 formed on each end of a handle, FIG. 7 shows the mattress border and back strap formed to align the grommet openings, FIG. 8 is a schematic view showing the pulling tool positioned to pull the anchor at the handle leading end through the aligned openings, with the handle following, FIG. 9 shows the pulling tool completing the motion of drawing the handle through the openings, FIG. 10 shows the end of one of the clamping members, FIG. 11 is a section of a clamping member in clamping engagement with a back strap, FIG. 12 shows the view of an installed handle from inside the mattress border, and FIG. 13 is an enlarged view of the coupling means.

Figure 1:
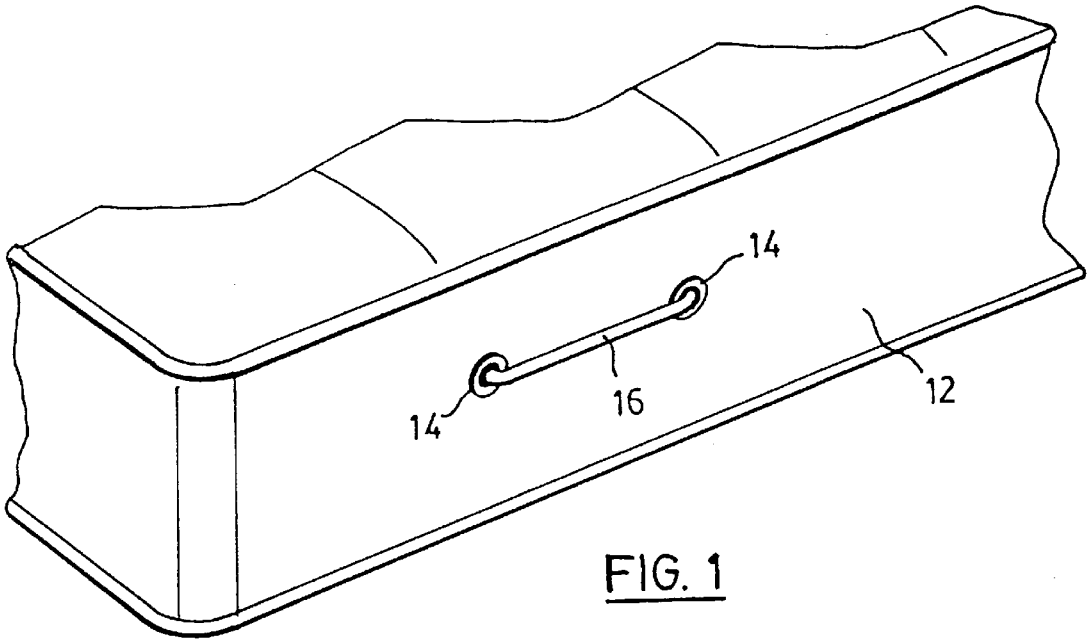

In FIG. 1 is shown a mattress having a top 10, a bottom (not shown) joined about their peripheries by a mattress border 12. At spaced locations (only one is shown) about the mattress border, are pairs of apertures defined by grommets 14. Extending through the apertures are the respective ends of a handle 16. The invention herein describes operations of installing the handle in the mattress border member before the top and bottom are attached to the mattress border.

Figure 2:
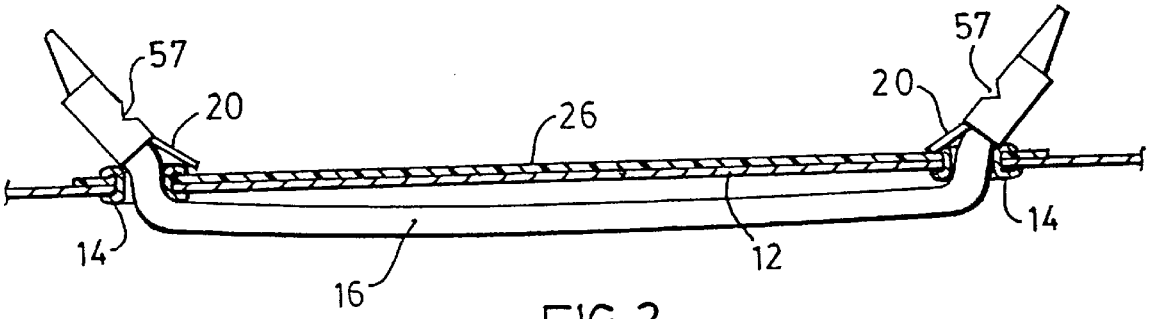

As shown in FIG. 2 the handle is a flexible member, usually a resilient core with a braided cover. Crimped onto each end of the flexible member is a metal end member which includes a clip 20 diverging from the flexible member in the direction toward the other anchor, and coupling extension 24, all to be described hereafter.

In FIG. 2, it will be noted that grommet 14 in addition to defining the apertures for the passage of the handle also attaches a flexible back strap 26 to be hereinafter described. However, it may be noted that with the handle installed as shown in FIG. 2, a pull on the handle will move the mattress because the clips 20 extend to contact respective grommets to retain it is position and the back strap 26 transfers the handle pull to the border.

It would be possible to construct clip 20 to have a resiliently flexible form to deflect inward when passing through the grommet hole in one direction, (coupling end first) but in the other direction to extend to catch the grommet to prevent withdrawal of the clip and anchor. However, and having regard for the preferred method of construction demonstrated in FIGS. 5 and 6, the clip 20 is of rigid material rigidly connected to the anchor material. The material of the handle 16, to which it is crimped is resiliently compressible radially although non extendible longitudinally. The radially compressible handle material allows the clip 20 and anchor to compress the handle material sufficiently to pass through the grommet opening, (coupling end first). However when travelling through the grommet opening in the opposite direction the resilient pressure of the handle material, the stresses on the handle and the angle of the clip 20 cause the last to catch on the grommet and prevent completion of such travel. The handle with its attached anchors and clips 20 should, in use, for best effect be oriented so that the clips contact each grommet ring on that part of the periphery nearest the other grommet ring.

Figure 3:
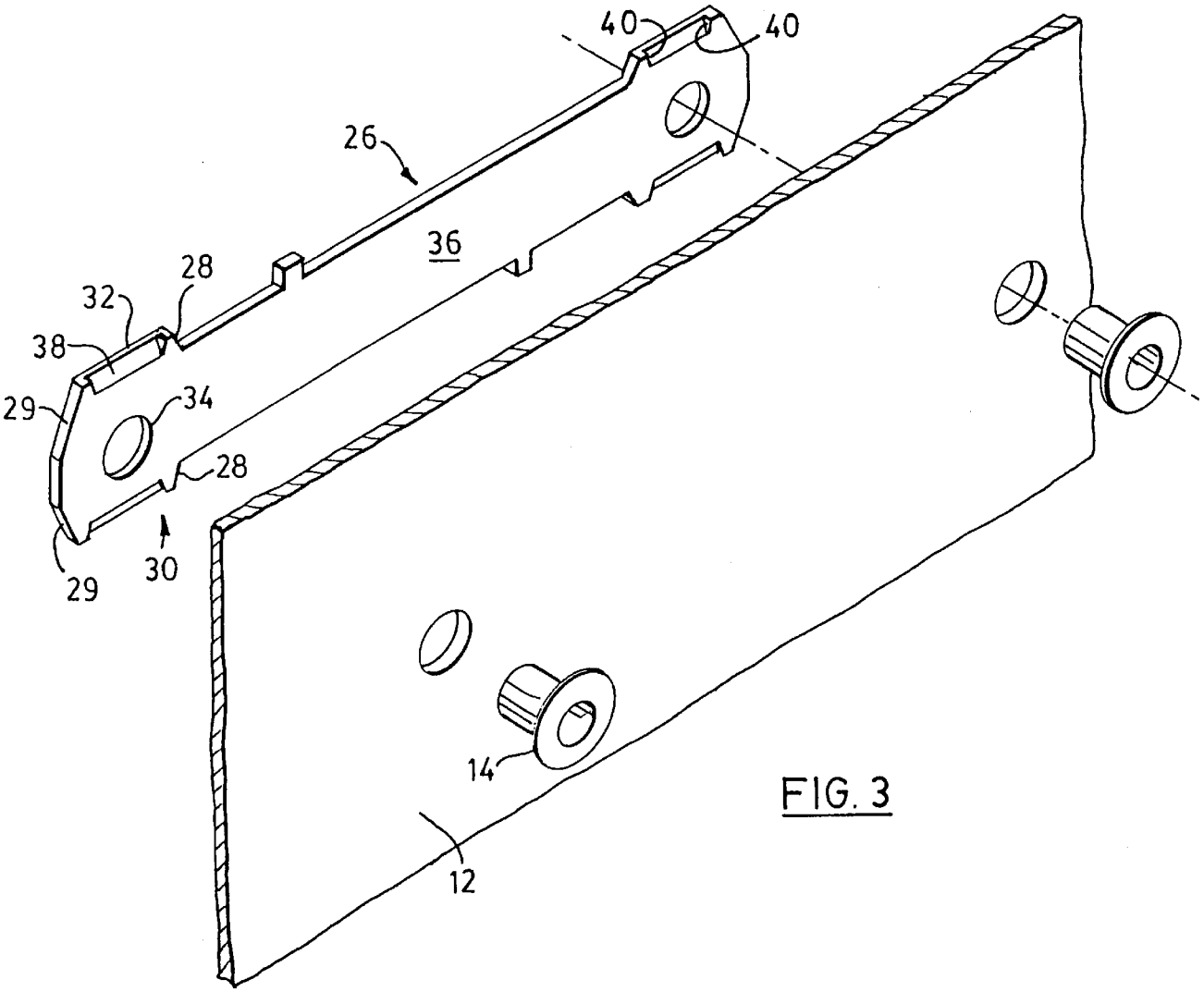
Figure 4:
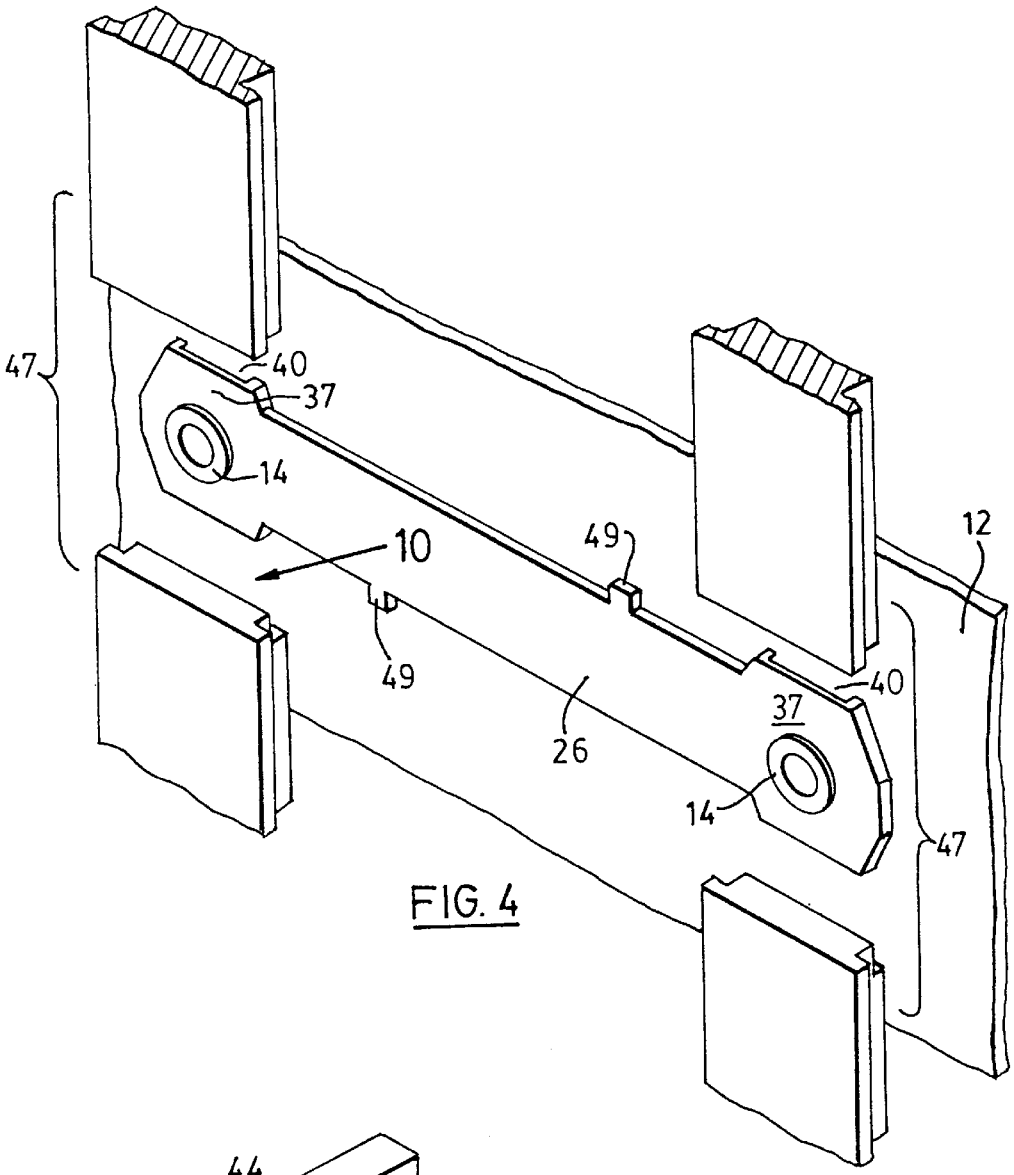

FIG. 3 shows the back strap 26 having widened ends surrounding grommet apertures 34, which widened ends, on each side of the back strap, are defined by converging edges 28 and 29 terminating at edge 32. Back strap 26 has outer surface 36 which will rest against the inside of mattress border 12. ("Outer" and "inner" herein refer to the outer and inner surfaces of the mattress border).

Chamferred areas 38 on the outer back strap side extend over the widened portions of ends 30 to edges 32, the area 38 sloping outwardly in the direction toward the apertures 34. At each end of chamferred edges 38 are opposed shoulders 40 which converge slightly from the edges 32 toward the longitudinal median of the back strap.

Figure 10:
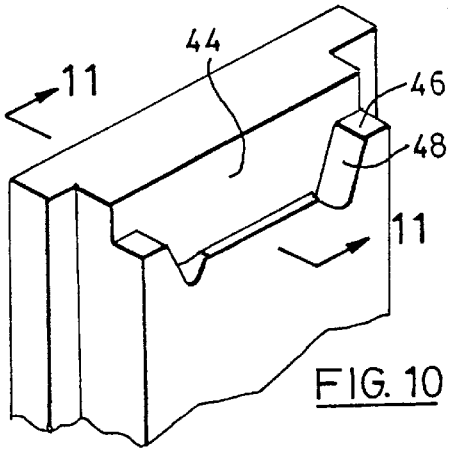
Figure 11:
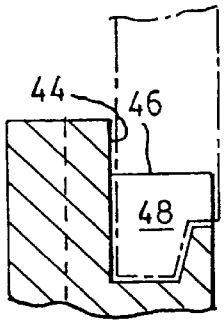

FIGS. 3, 4, 10 and 11 show the facing ends of opposed clamping bars 44 which facing ends are shaped to complement the side surfaces of the widened back strap ends. As best shown in FIG. 10, the lower end surface 46 of each clamping bar is stepped back so that surface 44 may ride over the inner surface of one side of the widening of back strap 26. The surface 46 is recessed to provide tapering surfaces 48 which complement walls 28 and 29 (FIG. 3) and define a recess shaped to complement and receive chamferred surface 38, edge 32, and opposing inner surface 37 of back strap 26 and edge 32. It will be seen that, when the clamping bars are moved to opposite sides of the back strap enlargement, they are guided into a clamping position, and the clamping bars as a pair, may be used as a unit to bend the back strap and mattress border from the position where the back strap 26 and mattress border 12 are straight (FIG. 4) to the position (FIG. 7) where mattress border and back strap have been bent so that the eyelets of grommets 14 are aligned.

It should be appreciated that alternative back strap clamping surfaces to those shown in FIGS. 1–13 may be provided at each end of the back strap 26. The only requirement is that the clamping means may be designed to clamp such clamping surfaces to bend the back strap 26 as required.

Tabs 49 project from opposite sides of the back strap adjacent respectively opposite ends. These are provided so that if there is an attempt to apply the back strap wrong side up, it may be detected.

Figures 5, 6:
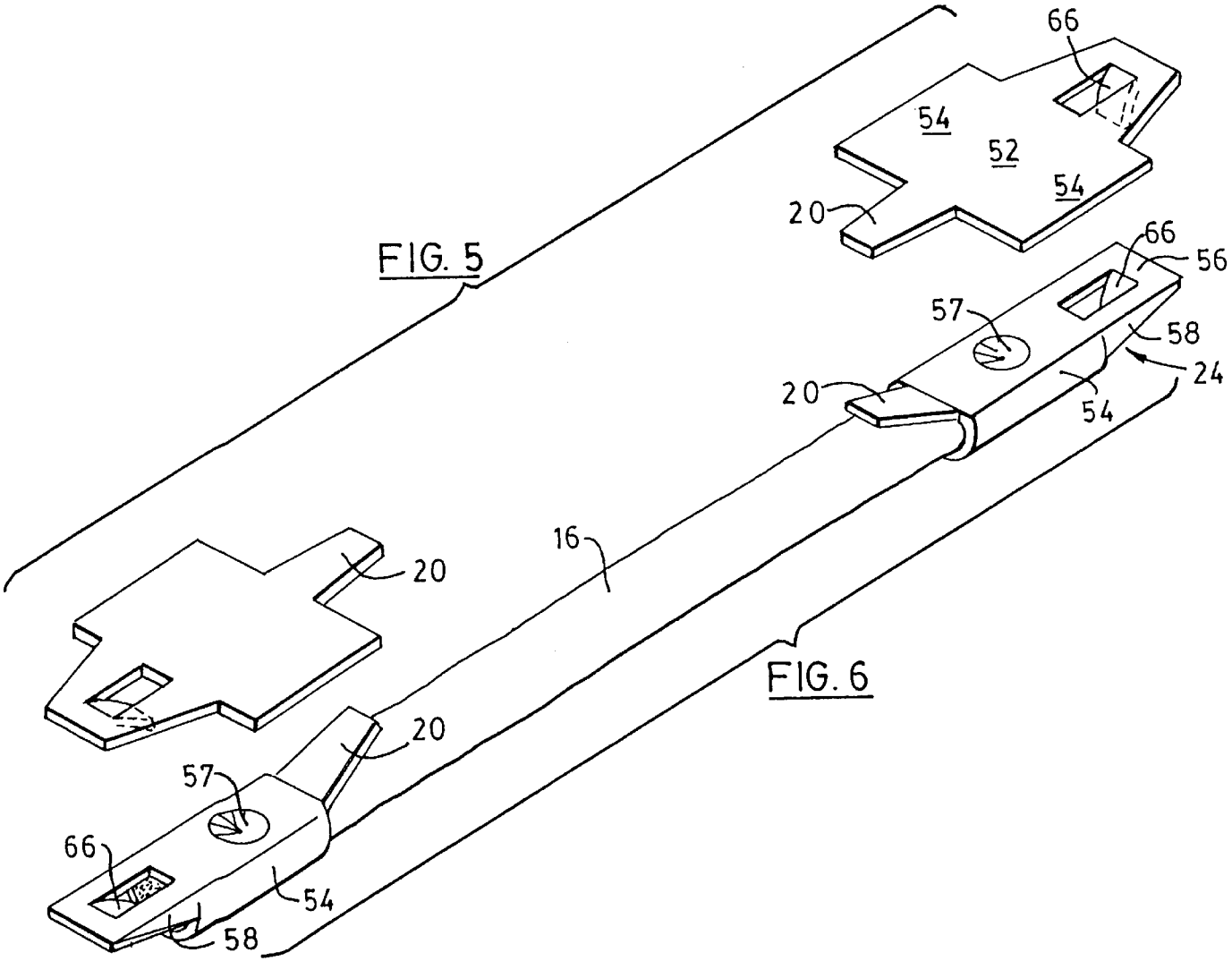

FIG. 5 demonstrates the formation of the handle and anchors.

The anchors are attached to each end of the handle by crimping anchor blanks thereabout.

It is very desireable for economy and efficiency that the anchors be designed to be stamped as a blank from a flat sheet of metal. The anchor blanks are shown in FIG. 5. Projecting from one end of the anchor blank to be as nearest the remote end is a tapering trapezoidal clip 20, designed, as shown in FIG. 6, to be bent to slope outwards in the direction toward the other end of the handle. The middle portion of the anchor blank nearer the clip has a central portion 52 with two outwardly extending wings 54 which, as shown in FIG. 6, are bent to crimp the end member to the resilient handle extent. The tapering portion of the blank at the end remote from the clip is bent into a U section, as shown in FIG. 6 with central portion 56 which is provided with an aperture and a tab 66 (an example of 'first coupling means') adapted when bent to extend inwardly toward the remote anchor, while diverging from the handle extent.

A dimple or depression 57 is made at the line of attachment of the anchor to the handle to give more positive attachment.

Figure 7:
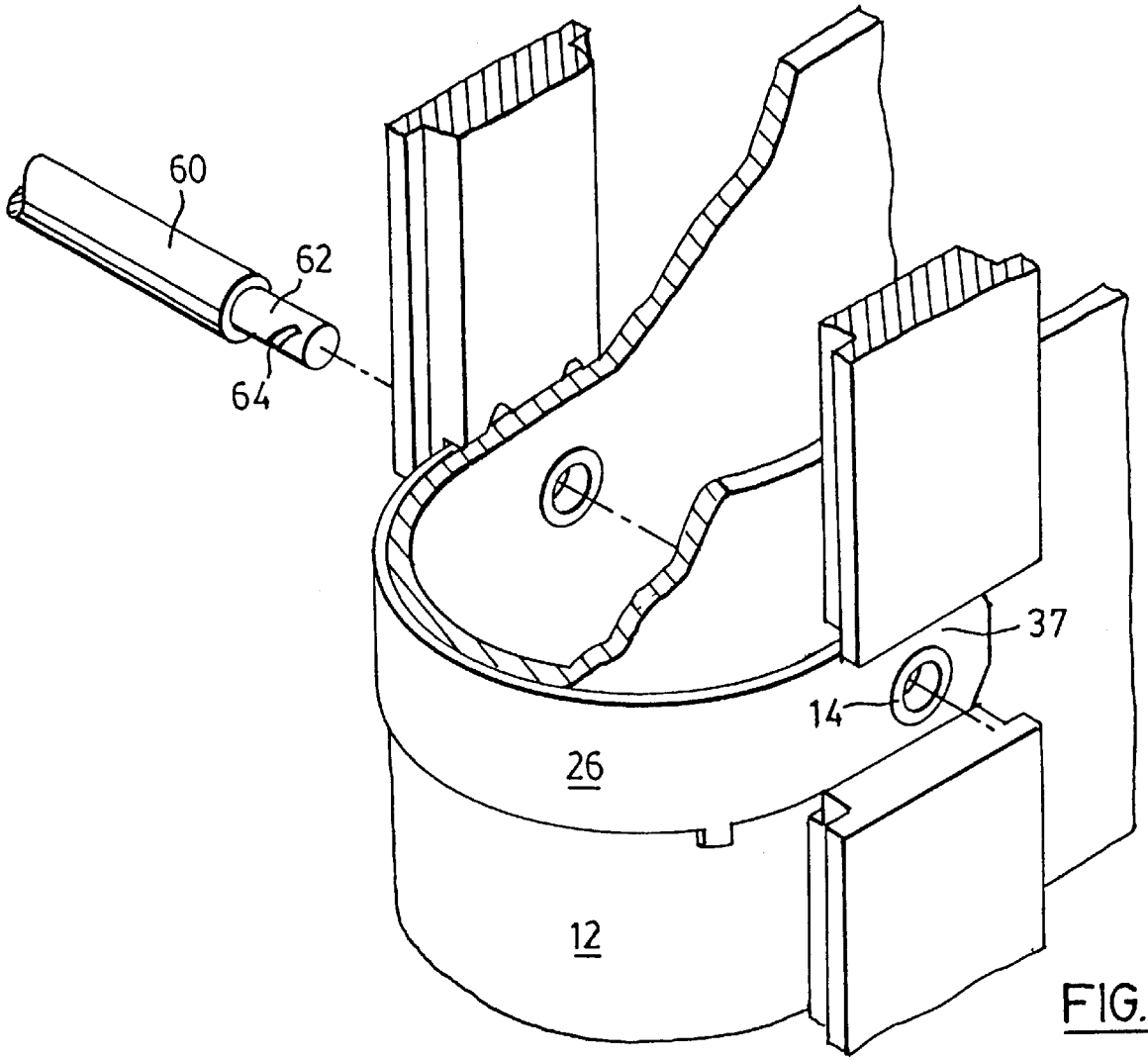
Figures 8, 13:
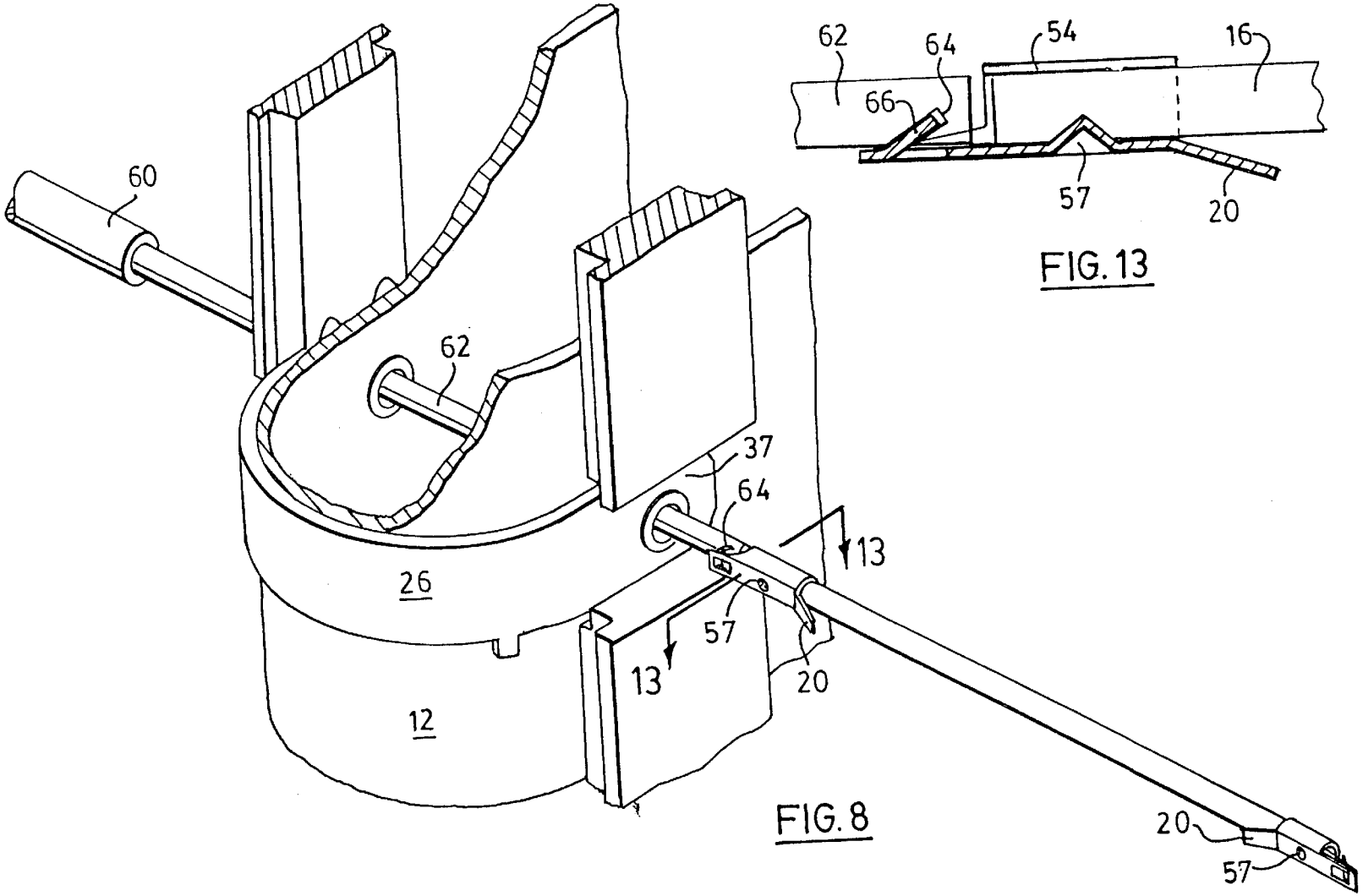
Figure 9:
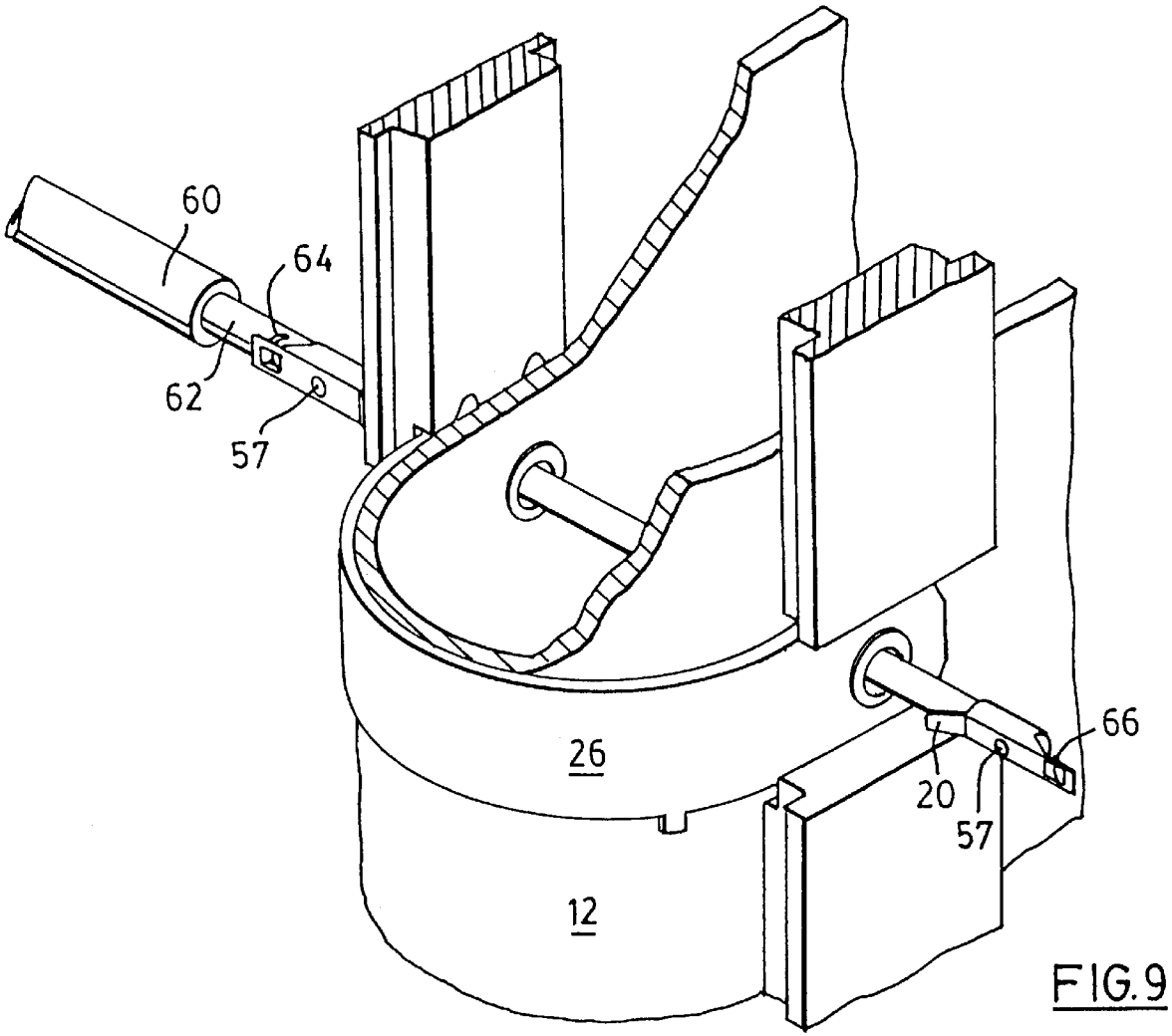

As shown in FIGS. 7, 8, and 9, a sleeve 60 is designed to slidably mount a pulling tool 62 for reciprocal movement therein. The pulling tool 62 is provided with a slot 64 at its outer end. The slot extends inwardly from the surface of the pulling tool, adjacent its end, and slopes in such inward extension toward that end (an example of second coupling means). The slope and dimension of the slot is designed to receive the tab 66 therein. With the coupling means of FIGS. 1–19 herein the rod 62 should, be means not shown, be keyed against rotation so that the rod approach tab 66 at the correct coupling angle.

Figure 12:
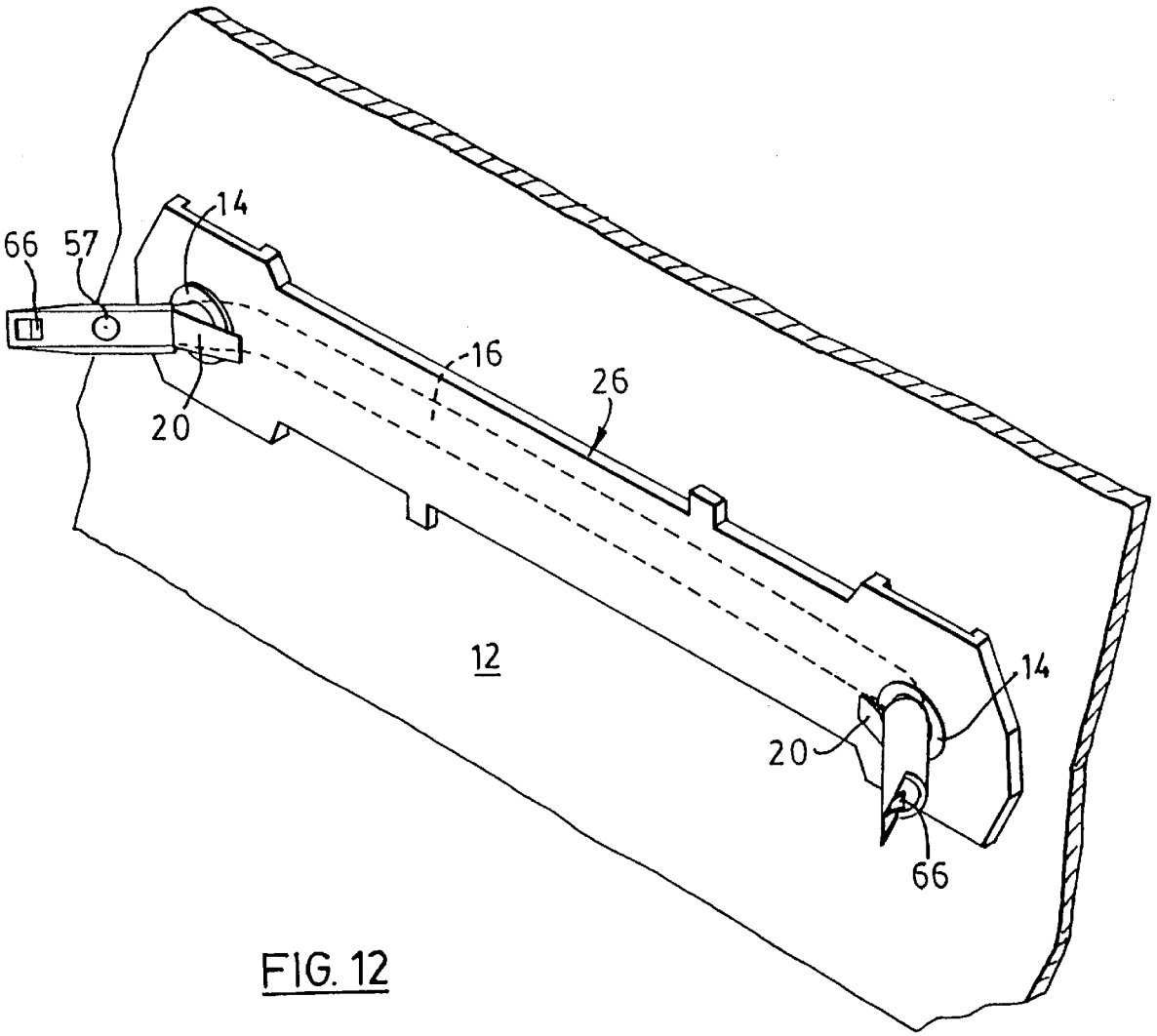

In operation, the back strap 26 is already attached to the inside of the border by grommets 14. The clamping bar pairs are used to clamp each end of the back straps and bend the back straps and borders to the "U" position of FIG. 7, with the outside of the mattress border on the concave side of the U. The pulling tool 62 with its slot 64 is then extended through the then aligned grommet apertures. When so extended the hook slot 64 is coupled to the adjacent tab 66 (FIG. 13). In so coupling it will be noted (FIGS. 8 and 6 that the side walls 58 which taper from the member 54 to the free end of the end member, tend to guide a pulling tool 62 into line with the anchor and its longitudinally extending handle 16. It will be noted that pulling tool and handle should on installation in the grommet openings be oriented about their longitudinal axis so that clips 20 will, when the handle is used, engage the edge of the grommet nearest the other grommet. With tab 66 in slot 64 the pulling tool 62 may be withdrawn to the position shown in FIG. 9. The leading clip 20 tilts slightly to pass through the grommet openings due to the yielding of the handle material. Thus the clip 20 on the leading end has passed through each grommet opening, being deflected as a unit with the rest of the anchor as it passes each opening. The handle is then retained by a clip 20 at each end; each contacting the periphery of the grommet ring on the extent nearest the other grommet which prevents withdrawal of the handle at either end from the grommet and the mattress border. The tab 66 is then removed from slot 64; and pulling tool 62 removed, by withdrawing the sleeve member 60 assisted by cam 74A similar to FIG. 74, and the mattress border, back strap and handle allowed to assume straight attitude with the handle installed as shown in FIG. 12.

Although the coupling means between the pulling tool 62 and the anchor, described previously, is preferred, any coupling means may be used within the scope of the invention which allows: (a) insertion of the pulling tool through a grommet opening or aligned grommet openings, depending on the variant used, (b) coupling to the anchor which is to be at the leading end of the handle during its installation, and (c) pulling the leading end through a grommet opening or the aligned grommet openings (depending on the variant used). It is implied in the above statements that the alternate coupling means has the profile to pass through the grommet openings, when coupled to the anchor.

It is also within the scope of the invention to use any alternate shaping of back strap clamping surfaces which can be clamped by complementary clamping means to cause the back strap, with boundary material, to be bent to align the grommet openings.

FIGS. 14A, 14B, 14C, 14D show the preferred method of decoupling a puller tool 62 from the handle anchor 54. The drawings show a puller tool 62 in the form of a rod, formed with slot 76 replacing slot 64, slidably mounted in a block 72 which faces the free end of the slot 76. (Slots 64 and 76 are examples of 'second coupling means'). Slot 76 has a side wall 77 to contact tab 66 and side wall 77 is inclined to be approximately parallel to slot 66. Block 72 replaces sleeve 60 and provides a sloping face 74, sloping, looking in the pulling direction toward the open end of slot 76 toward which the slot opens. The anchor 54 and side walls 58 are larger, in section, perpendicular to the longitudinal direction of the adjacent portion of the handle, than the bore in block 72.

Figures 14A, 14B, 14C, 14D:
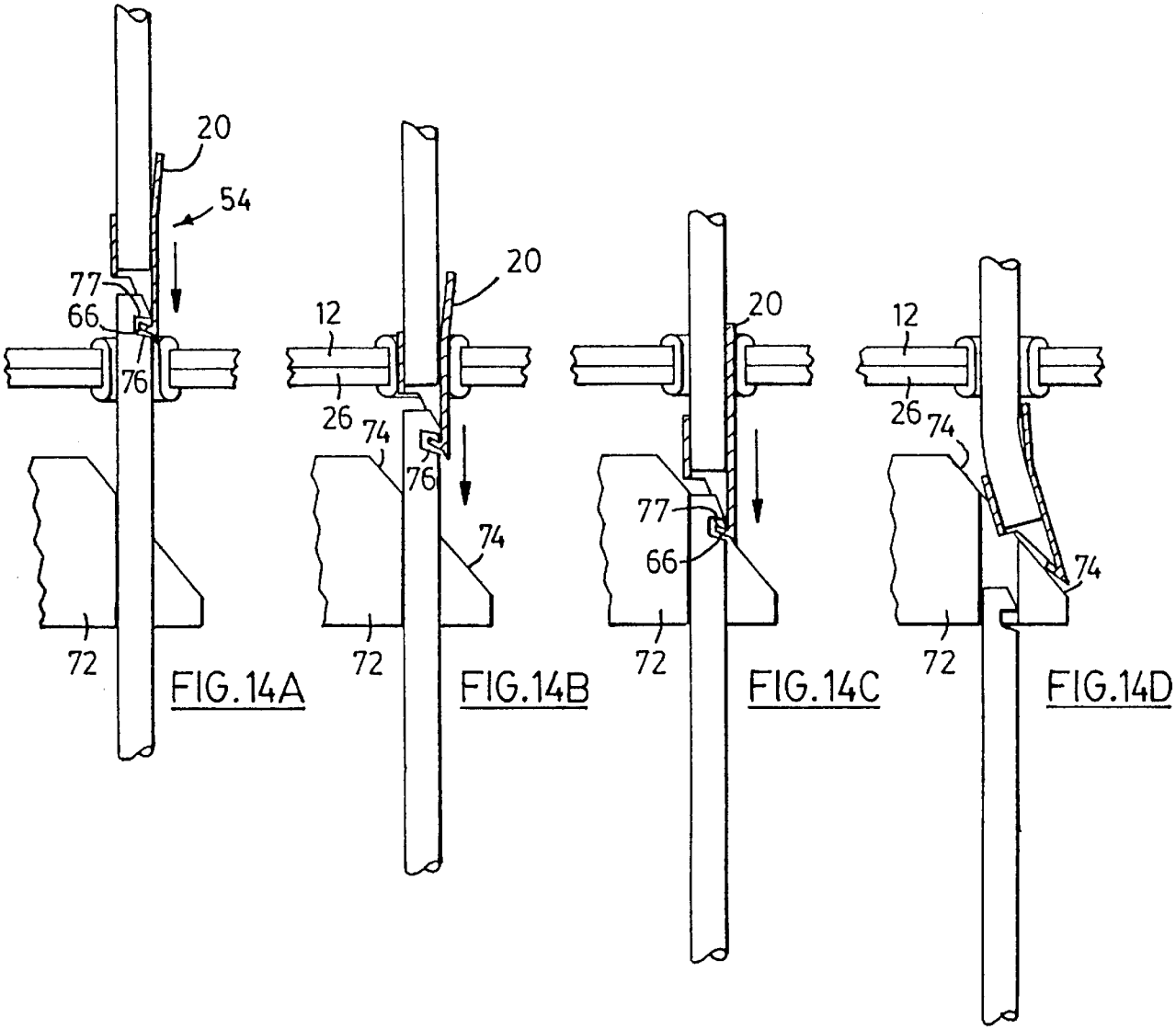
FIGS. 14A to 14D are schematic views showing an example of the preferred mode of decoupling the pulling tool from a handle anchor.

Accordingly in FIG. 14A, the pulling tool 62 with slot 76 and tab 66 coupled, is drawing the leading anchor 54 toward passage outside to inside through a grommet opening (that on the left in FIGS. 7–12). In FIG. 14B the anchor has been drawn through the grommet opening and in FIGS. 14C the puller rod has drawn the anchor walls 58 into contact with the sloping cam face 74. In FIG. 14D as the downward movement continue the puller tab 66 has achieved disconnection from slot 74, that is decoupling between the pulling tool and the anchor.

In FIGS. 14A to 14D the grommet farther from the cam surface is not shown nor are the clamping means.

The position of a chamferred face 74A on the sleeve 60 of each of FIGS. 7, 8, and 9 allows the same decoupling procedure as discussed in FIGS. 14A–14D.

A second variant of means for installing the handle is shown schematically in FIG. 15. The handle is preferably handle 16 of the type shown in FIG. 1–13, although it may take other forms consistent with the scope of the invention. The back strap 26 and its attachment to the border may also be as shown in FIGS. 1–13 or of a different form within the scope of the invention.

Figure 15A:
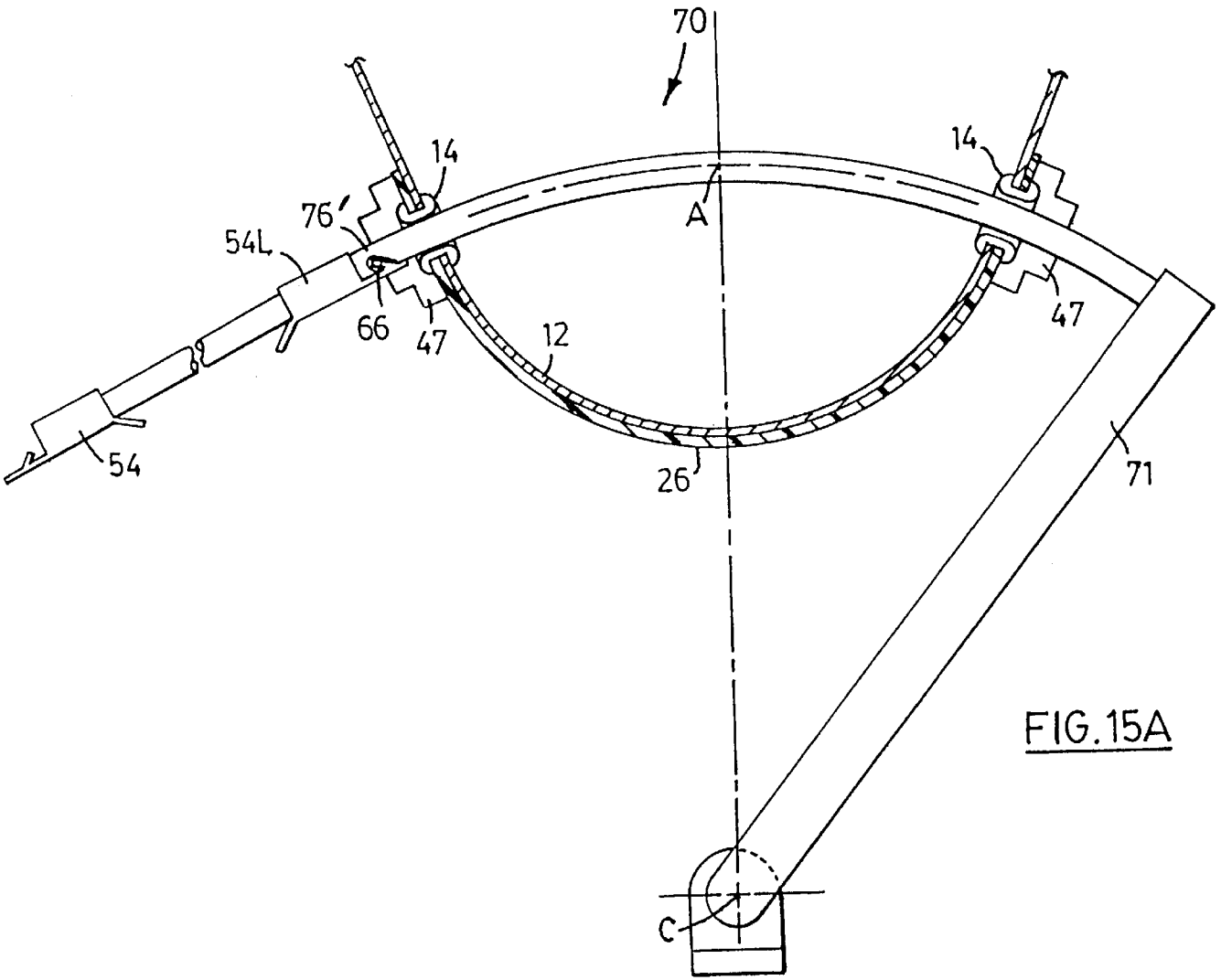
FIGS. 15A and 15B show a second variant on the method of installing a handle on the border.
Figure 15B:
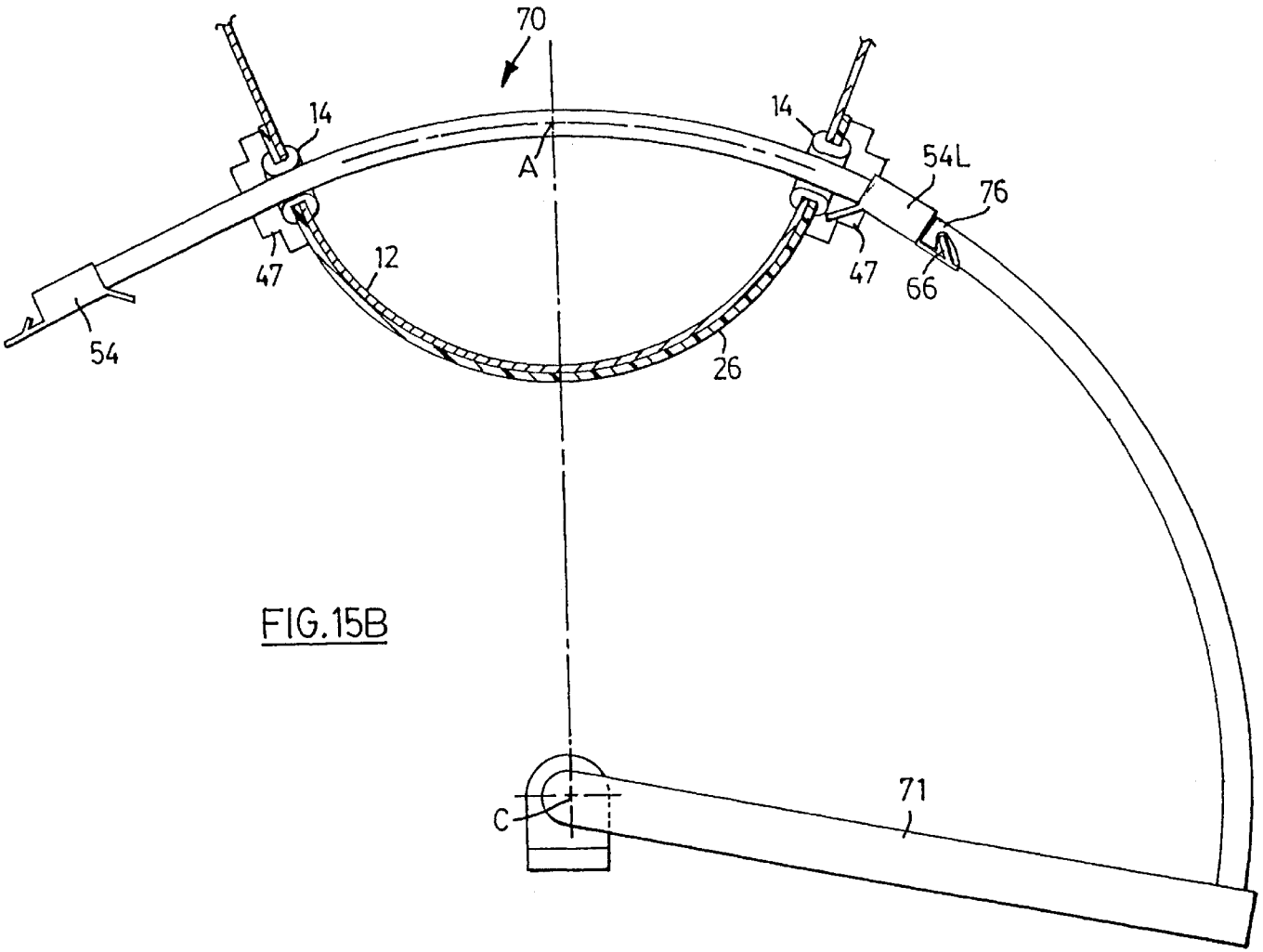

With the components of FIGS. 15A, 15B the clamping means 47 are clamped to each end of the back strap 26 with the outer surface of the border concave upward, so that the grommet 14 openings are on a common circular arc A. A puller tool 70 is mounted on an arm 71 pivotal about the centre C of Arc A and shaped to follow the arc. The puller tool 73 will be shaped at its free end to detachably couple to the handle first coupling means by any convenient means such as notch 76 and tab 66. The handles are releasably but accurately positioned for coupling of tabs 66 in notch 76.

Accordingly, the upper border 12 and lower back strap 26 are bent and positioned concave upward and the leading end of the handle, with first coupling means (tab 66) thereon, is positioned facing the inner side of the grommets opening farthest from the arm 71.

The arm 71 is then operated in the anti-pulling direction to propel the coupling tool counterclockwise in FIGS. 15A and 15B through the two grommets, after which the coupling tool's second coupling means 76 couples to the anchor's first coupling means 66 (with the components now in the position of FIG. 15A) and the arm is then rotated clockwise in the pulling direction to pull the leading anchor 54L of the handle through the two grommets 14, achieving the position of FIG. 15B. The pulling tool 70 is then decoupled from the anchor 54L. The handle is installed.

Detachment means of the puller tool from the anchor, as in all embodiments, may be in any effective form. However, I prefer to use the method resembling that shown in FIGS. 14A to 14D. Although not shown in FIGS. 15A, 15B. With the variant of FIGS. 15A, 15B the pulling tool encompasses an arc of a circle and located, although not shown, clockwise from the right-hand grommet must slide in a similarly shaped bore. Such a bore may be made in two arcuate halves with half the tool section formed in each half and the halves mounted at the sides of the pulling tool. The entrance will be cam-shaped to disengage the handle from the pulling tool. A cam surface for decoupling which generally operates as that in FIGS. 14A to 14D may then be provided to decouple the pulling tool coupling means 76 from the leading anchor coupling means 66.

In FIGS. 16–19, a third inventive method of installing the inventive handle is shown. In contrast to the prior methods, the design of the handle may be that shown with previous variants but having first coupling means 66 on the anchor 54 at each end. There is a separate pulling tool 62 for each grommet opening associated with the handle and each pulling tool pulls its associated handle end, through the associated grommet opening, from outside to inside relative to the border and backstrap.

Figure 16:
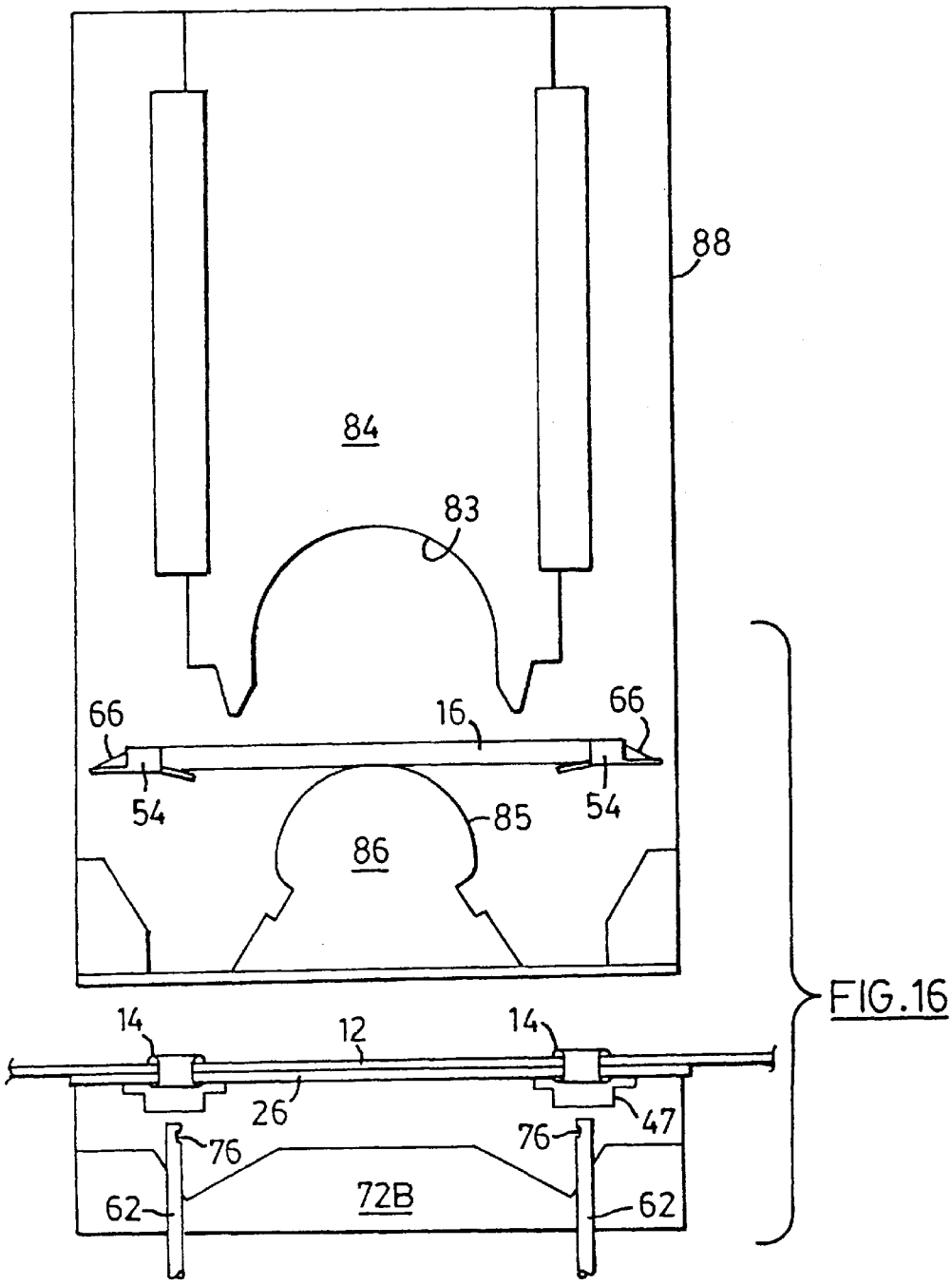
FIGS. 16–18, 18A and 19 show a third variant on the method of installing the handle on the border.

As shown in FIG. 16, a handle 16 is fed, to and maintained in a horizontal position between shaping surface 85 of lower shaping member 66. Upper shaping member 84 provides shaping surface 83 which is shaped with surface 85 to clamp handle 12 therebetween when lowered into position. Border 12 and back strap 26 are maintained in position and horizontal below shaping surface 85. Located below each grommet 14 and concentric therewith is a retracted, upwardly projecting pulling tool 62 seated in cammed blocks 72B shaped to decouple the tool from an anchor in the manner demonstrated in FIGS. 14A–14D. The pulling tools 62 are oriented so that the grooves 76 face each other.

Figure 17:
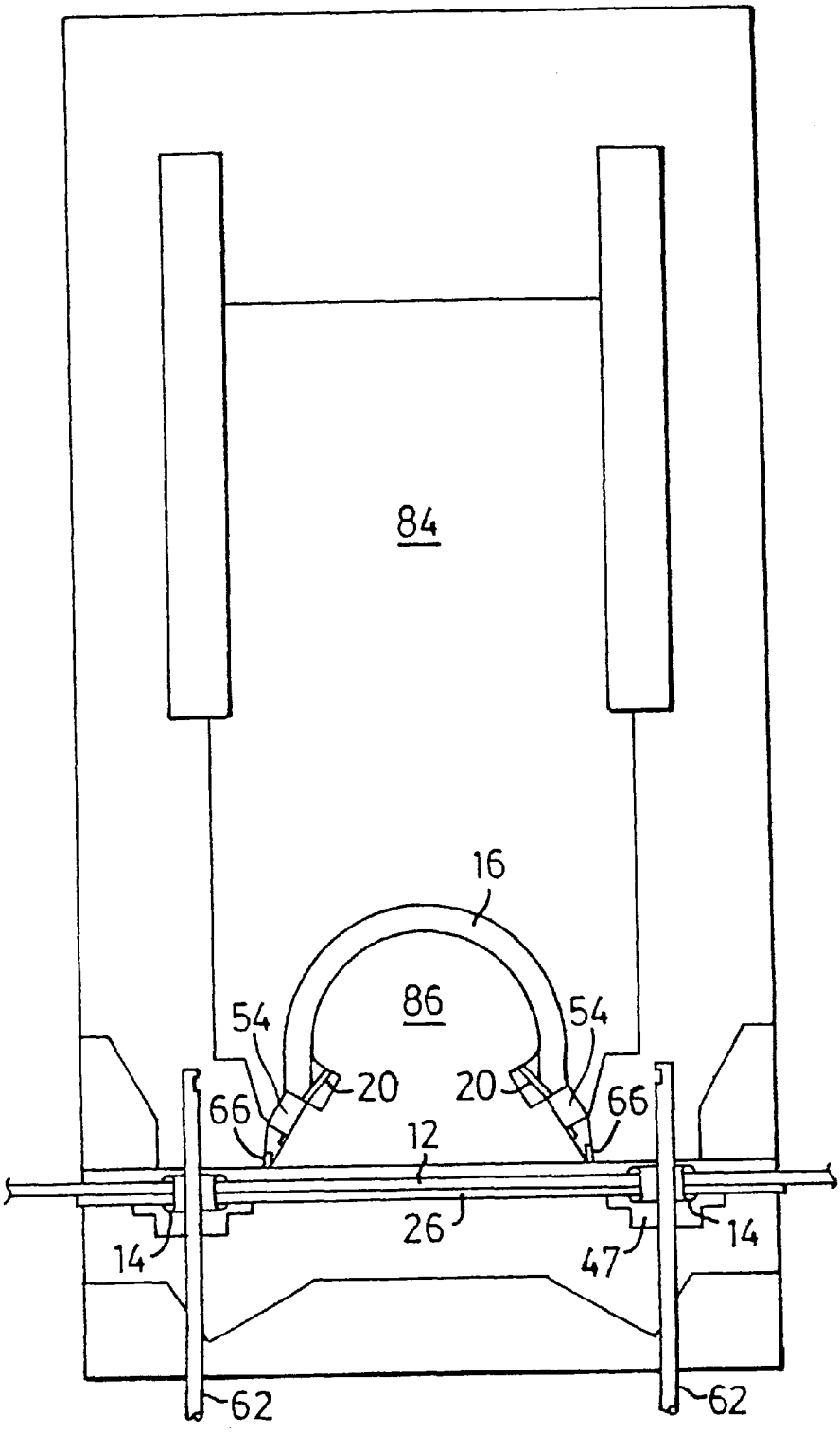

As shown in FIG. 17 the upper shaping member 84 has been lowered so that in combination with lower shaping member 86 it clamps the handle 16 in the concave downward curve shown with the anchors 54 precisely positioned, by means not shown, with the clips 20 on each anchor facing the other. The main body 88 is lowered. The pulling tools have each been extended in the anti-pulling direction to extend through the respective openings of grommets 14, the tools are precisely positioned by means not shown and oriented to face each other. The clamping means 47 are then actuated the border 12 and back strap 26 are bent into the concave upward V shown in FIG. 18. The tools 62 and blocks 72 are mounted to respectively move with the motion of their respective adjacent clamping means 47 and the notches 76 in each rod 62 are moved to receive tabs 66, so that the second coupling means are now coupled to the first coupling means.

Figure 18:
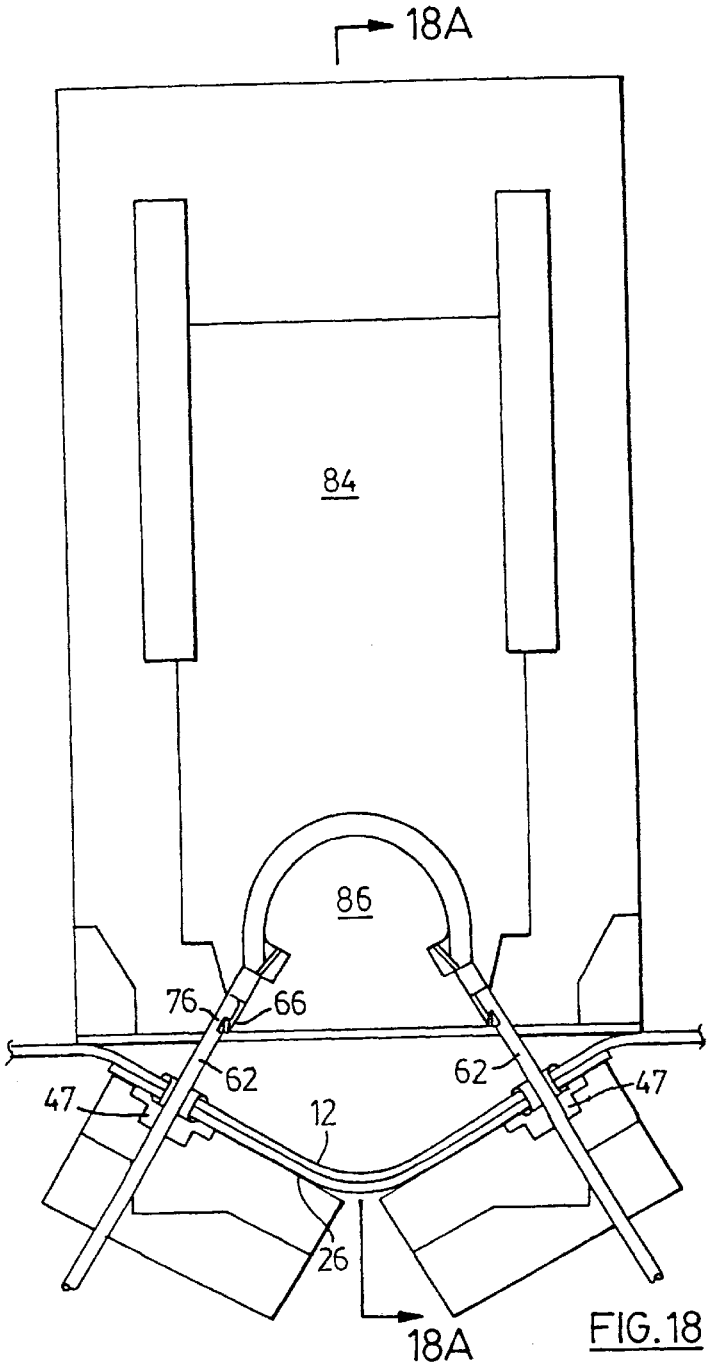
Figure 18A:
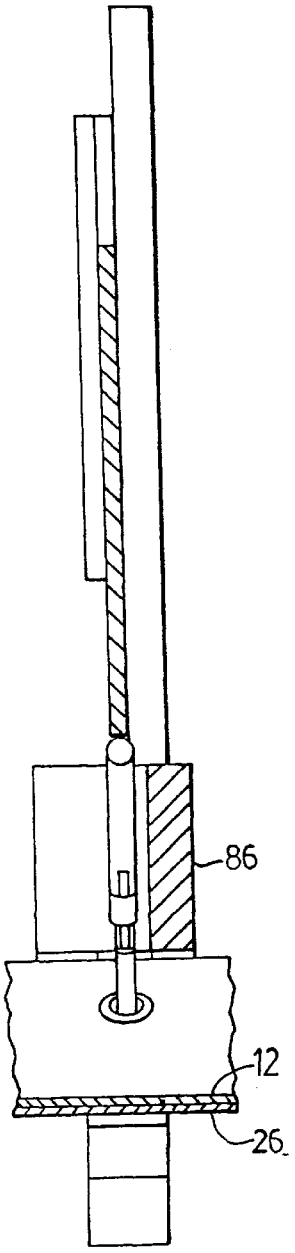
Figure 19:
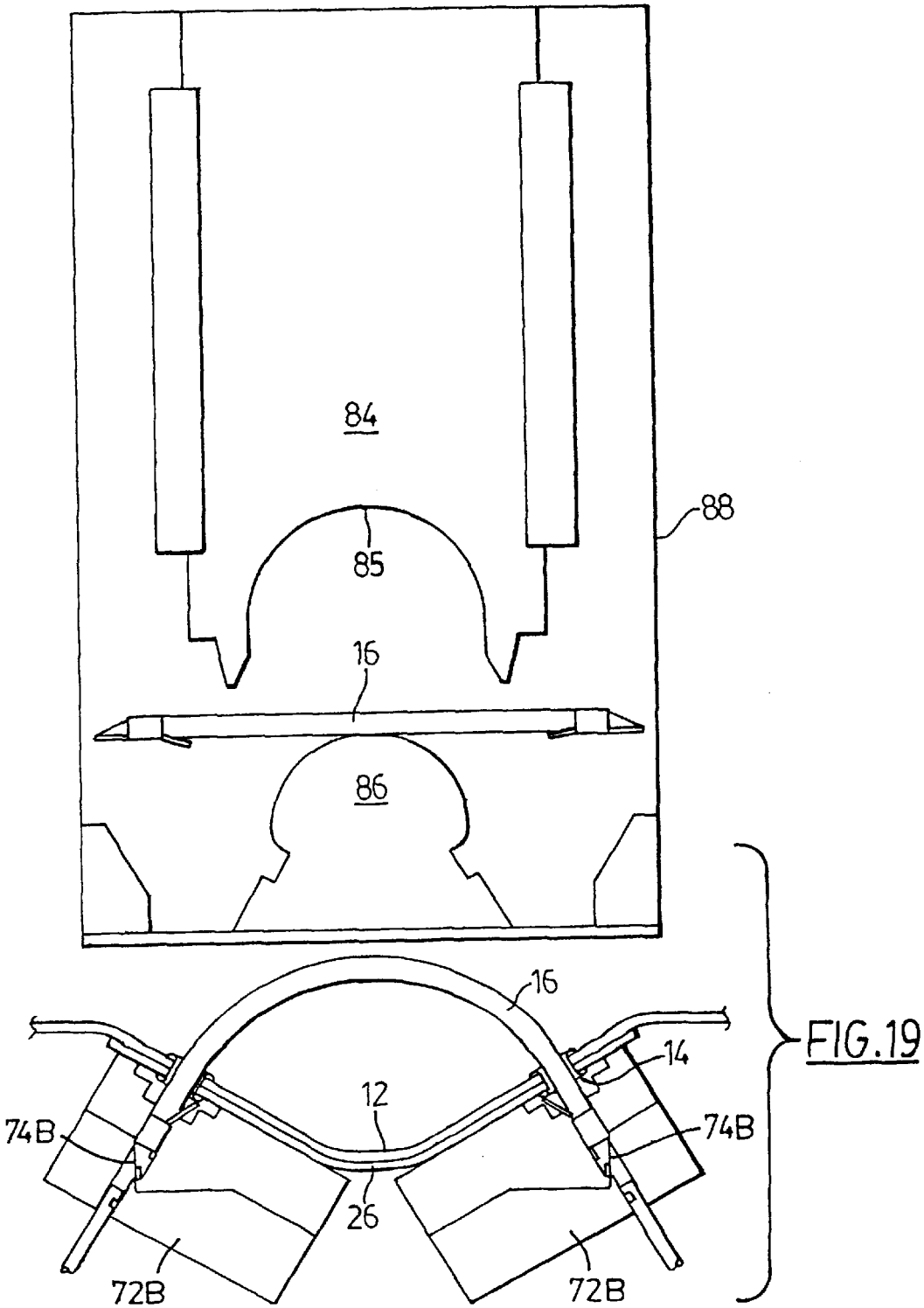

As shown in FIGS. 18A the lower shaping member 86 is moved laterally (that is perpendicular to the plane of the paper in FIGS. 16, 17, 18, 19) to allow downward movement of the handle. The coupling rods 62 are then actated to draw the respective anchors through the grommet openings to the position shown in FIG. 19. The cam surface then decouple each tab 66 from block 72. Member 84 and the main body 88 are raised. The handle is now installed and the border, back strap and handle are flattened. The border, back strap and handle will now be moved longitudinally, in the plane of the paper to prepare for the next operation. A new handle is located above shaping member 86 which has been moved laterally to its position vertically aligned with member 84.

Figure 20:
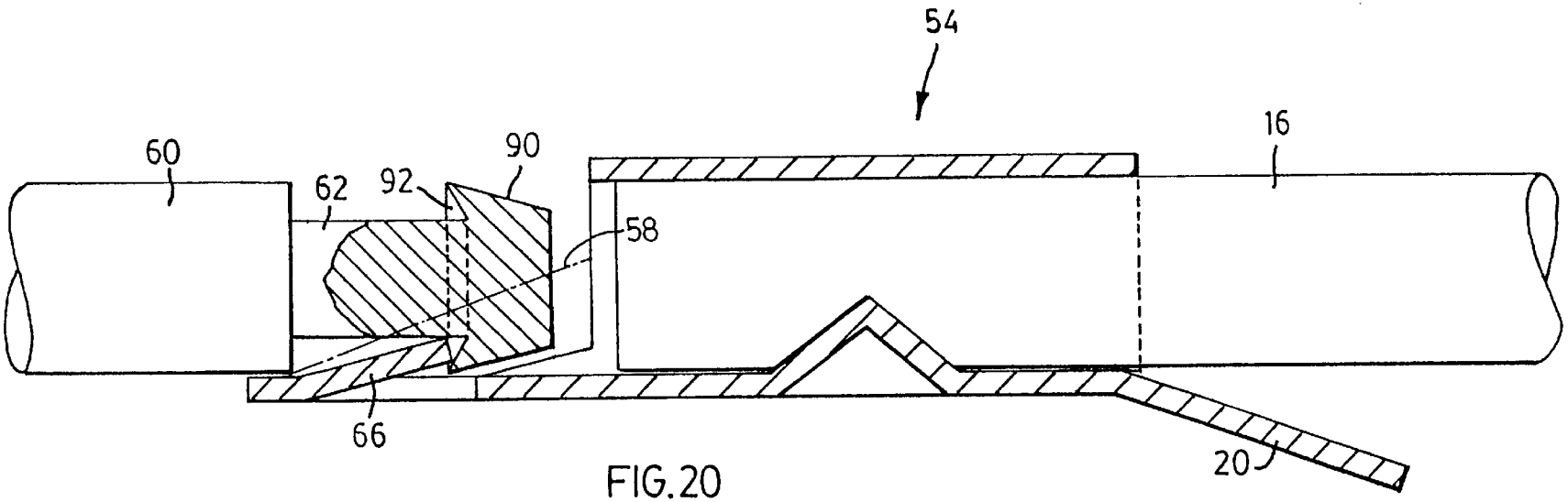
FIG. 20 shows an alternate design of the coupling means.

FIG. 20 shows a coupling means having the advantage that the second coupling means 90 is a surface of revolution so that puller rod 62, slidable in sleeve 60 as shown, or sliding in a block 72 or 72B, (FIGS. 14 and 19) need not be keyed for rotation about its longitudinal axis.

Thus the second coupling means 90 is a surface of revolution, here a truncated cone, tapering toward the free end. The wider and surface of the cone may be provided with an inverted conical face 92, as shown, to make a more positive contact with clip 66 or anchor 54.

Anchor 54 may be generally as shown in FIG. 6 although the tab 66 may be slightly curved and tapered to make more certain contact with the surface defining recess 92.

What is claimed is:

1. The method of installing a handle in a mattress border material having an inner and an outer surface and a pair of spaced first apertures in said border material, a flexible back strap located on the inside surface of said border material, said back strap having a pair of second apertures colinearly aligned with the pair of first apertures of said border material, a pair of grommets extending through and surrounding each of said pair of apertures in said border material back strap, said handle comprising a longitudinally extending flexible handle having two ends, an anchor attached to each end of said handle, each said anchor including a clip diverging from the end in the direction toward the other anchor, and first coupling means on said anchor, and a pulling tool having second coupling means for coupling said pulling tool to the first coupling means of one of said anchors, said method comprising the steps of:

bending said back strap and said border material into a U shape so that said inside surface of said border material is convex outward and so that said first apertures are aligned;

inserting said pulling tool through said aligned apertures;

coupling said second coupling means of said pulling tool to the first coupling means of one of said anchors;

using said tool to pull said handle so that said one of said anchors passes through both of said first aligned apertures.

2. The method as claimed in claim 1 wherein said back strap includes a plurality of clamping surfaces located adjacent each aperture of said back strap, and wherein said method includes, prior to bending said back strap, the step of attaching clamping means to said clamping surfaces adjacent to each aperture of said back strap and using said clamping means to achieve said bending.

3. The method of installing a handle in a mattress border, wherein said handle comprises a longitudinally extending flexible handle extent having two ends, an anchor attached to each extent end, each said anchor including a clip, diverging from the extent end in the direction toward the other anchor, first coupling means on said anchor for coupling to a second coupling means on a pulling tool, said mattress border comprising:

border material having an inner and an outer surface, a pair of spaced first apertures in said border material, a grommet attached to said border material to surround each said first aperture, a flexible back strap, located on the inside surface of said material, said back strap having a pair of second apertures, said back strap being attached to said border material by each grommet and located thereby so that each second aperture aligns with a first aperture to form an aligned set of apertures, said method comprising the steps of, bending said back strap and said material into a U shape so that said inside surface is convex outward and so that said first apertures are aligned, inserting a pulling tool through said aligned apertures, coupling said second coupling means to the first coupling means, using said tool to pull said handle so that said one of said anchors passes through said first aligned apertures.

4. In the method as claimed in claim 3 wherein said back strap includes a plurality of clamping surfaces adjacent each aperture, and wherein said method includes, prior to bending said back straps the step of attaching clamping means to each of said pluralities and using said clamping means to achieve said bending.

* * * * *

UNITED STATES PATENT AND TRADEMARK OFFICE

CERTIFICATE OF CORRECTION

PATENT NO. : 6,176,002 B1
DATED : January 23, 2001
INVENTOR(S) : Lothar Korb

It is certified that error appears in the above-identified patent and that said Letters Patent is hereby corrected as shown below:

Column 3,
Line 64, "is" should be -- in --.

Column 5,
Line 26, "be means" should be -- by means --.

Column 7,
Line 32, the numeral "66" should be -- 86 --.
Line 59, "FIGS. 18A" should be -- FIG. 18A --.
Line 64, "cam surface" should be -- cam surfaces --.

Column 8,
Line 12, "wider and surface" should be -- wider end surface --.

Signed and Sealed this

Thirteenth Day of November, 2001

*Attest:*

Nicholas P. Godici

NICHOLAS P. GODICI
*Acting Director of the United States Patent and Trademark Office*

*Attesting Officer*